US007833961B2

(12) United States Patent
Declercq et al.

(10) Patent No.: US 7,833,961 B2
(45) Date of Patent: Nov. 16, 2010

(54) FABRIC ENHANCING COMPOSITIONS COMPRISING NANO-SIZED PARTICLES AND ANIONIC DETERGENT CARRY OVER TOLERANCE

(75) Inventors: Marc Johan Declercq, Strombeek Bever (BE); Yonas Gizaw, Cincinnati, OH (US); Raul Victorino Nunes, Loveland, OH (US); Ke-ming Quan, West Chester, OH (US); Alessandro Corona, III, Mason, OH (US); Matthew Lawrence Lynch, Mariemont, OH (US); Alice Marie Ward, Middletown, OH (US); Hugo Jean Marie Demeyere, Merchtem (BE)

(73) Assignee: The Procter & Gamble Company, Cincinnati, OH (US)

( * ) Notice: Subject to any disclaimer, the term of this patent is extended or adjusted under 35 U.S.C. 154(b) by 460 days.

(21) Appl. No.: 11/890,923

(22) Filed: Aug. 8, 2007

(65) Prior Publication Data

US 2008/0263780 A1 Oct. 30, 2008

(51) Int. Cl.
*C11D 1/835* (2006.01)

(52) U.S. Cl. ..... 510/522; 510/527

(58) Field of Classification Search ..... 510/522, 510/527

See application file for complete search history.

(56) References Cited

U.S. PATENT DOCUMENTS

| | | | | |
|---|---|---|---|---|
| 3,954,634 | A | 5/1976 | Monson et al. | |
| 5,525,245 | A * | 6/1996 | Grandmaire et al. | 510/524 |
| 2002/0001613 | A1 | 1/2002 | Niemiec et al. | |
| 2002/0119188 | A1 | 8/2002 | Niemiec et al. | |
| 2003/0143181 | A1 | 7/2003 | Hensen et al. | |
| 2004/0060390 | A1 | 4/2004 | Carden | |
| 2005/0176598 | A1 | 8/2005 | Bergquist et al. | |
| 2006/0252668 | A1 | 11/2006 | Frankenbach et al. | |

FOREIGN PATENT DOCUMENTS

| | | | |
|---|---|---|---|
| EP | 0309052 | A | 3/1989 |
| WO | WO 2008/040785 | A1 | 4/2008 |

* cited by examiner

*Primary Examiner*—John R Hardee
(74) *Attorney, Agent, or Firm*—Gary J Foose; Leonard W Lewis; Melissa G Krasovec

(57) ABSTRACT

A fabric enhancing composition comprising: at least one fabric softening active, wherein said fabric softening active comprises a plurality of particles comprising a intensity weighted particle size distribution wherein at least about 50% said particles have a particle size below about 170 nm.

3 Claims, 1 Drawing Sheet

FABRIC ENHANCING COMPOSITIONS COMPRISING NANO-SIZED PARTICLES AND ANIONIC DETERGENT CARRY OVER TOLERANCE

BACKGROUND

The need for fabric enhancing composition with sufficient anionic detergent carry over tolerance has been reported. Benefits reported to be associated with suitable anionic detergent carry over tolerance include but are not limited to: clear rinse solution, floc inhibition and delivering soft hand feel to the fabrics when added to a rinse solution containing residual detergent surfactant. See e.g. U.S. Pat. Publ. No. 2004/0060390 A1 to Demeyere et al. Attempts have been made to provide fabric enhancing compositions capable of good anionic detergent carry over tolerance through the use of additives, such as surfactant scavengers. Additives such as surfactant scavengers, however, can be expensive and cause processing and manufacturing complexities such as additional steps in combining ingredients. As such, there remains a need for fabric enhancing compositions providing good anionic detergent carry over tolerance without reliance upon added surfactant scavengers.

Another approach to provide good anionic detergent carry over tolerance benefits involves the use of specific mixtures of mono-tail and di-tail cationic fabric softener actives. See e.g. U.S. Pat. Publ. No. 2006/0252668 A1 to Frankenbach et al. Although, this approach reportedly provides some floc inhibition benefits, these formulations approaches have similar problems such as being expensive and causing processing and manufacturing complexities. Further, reliance on specific levels of mono-tail and di-tail cationic fabric softener actives limits the potential types and combinations of fabric softening materials which can be used.

There remains a need for new fabric enhancing compositions capable of providing sufficient anionic detergent carry over tolerance and floc inhibition without requiring the presence of additives such as surfactant scavengers and/or specific levels of mono-tail to di-tail cationic fabric softening actives.

SUMMARY OF THE INVENTION

One aspect of the present invention provides for a fabric enhancing composition comprising: at least one fabric softening active, comprises a plurality of particles comprising a intensity weighted particle size distribution wherein at least about 50% of said particles have a particle size below about 170 nm.

Another aspect of the present invention provides for a method for rinsing a fabric comprising the step of contacting the fabric, previously contacted with an aqueous detergent liquor, with a rinse solution containing the fabric enhancing composition according to the present invention.

Another aspect of the present invention provides for a method of reducing the volume of water consumed in a manual rinse process comprising the steps: incorporating a fabric conditioning composition according to the present invention in an aqueous bath; and immersing the fabric in the aqueous bath subsequent to contact with a detergent liquor.

DETAILED DESCRIPTION

Definitions

Figure 1:
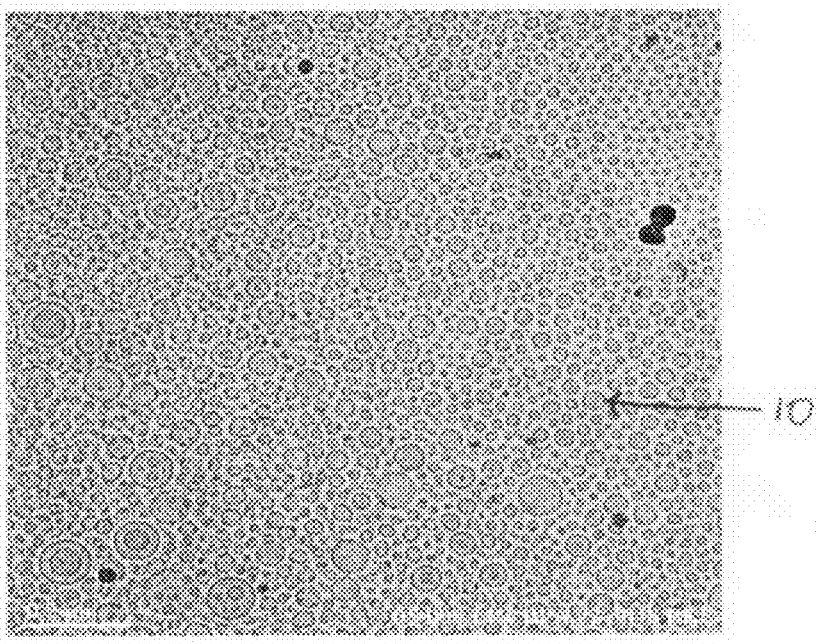
FIG. 1 provides a Cryo-TEM micrograph of nano-sized particles comprising a plurality of nano-sized lamellar vesicles according to the present invention.

As used herein, the term "laundry residue" means any material that may be present either on the fabrics or in the wash liquor during the wash cycle of the laundering process and that is carried over with the laundered fabrics into the rinse bath solution. Thus, "laundry residue" includes, but is not limited to, residual soils, particulate matter, detergent surfactants, detergent builders, bleaching agents, metal ions, lipids, enzymes and any other materials that may have been present in the wash cycle solution.

As used herein, "rinse bath solution" is the solution used to rinse the fabrics subsequent to their washing. The rinse bath solution may be used in an automated or non-automated washing machine, or in the case of hand washing, may be used in a simple container such as a basin or bucket. The rinse bath solution is initially water before the laundered fabrics and accompanying laundry residue and/or the rinse-added fabric treatment composition are introduced.

As used in the following description and claims, "visible precipitates" or "flocs" refer to flocculated matter which is generally opaque in nature. Although not necessarily solid or compact, such flocs are sufficiently large to be noticeable by the unaided eye, typically, not less than about 0.4 mm when measured along their shortest axis.

I. Fabric Enhancing Compositions

It has surprisingly been found that fabric enhancing compositions comprising at least one fabric softening agent comprising a plurality of particles, wherein at least about 50% by weight of said particles have a particle size below about 170 nm, (hereinafter "nano-sized particles"), provides good anionic detergent carry over tolerance without the addition of additives including, but not limited to: surfactant scavengers and specific mixtures of mono-tail and di-tail cationic fabric softener actives. In one embodiment, said nano-sized particles comprises a plurality of lamellar vesicles. Without intending to be bound by theory, it is believed that the nano-sized particles, as defined herein, provide sufficient exposure of cationic charge to scavenge at least a portion of any detergent surfactant compositions and/or laundry residue present in the rinse solutions of automatic and manual hand washing systems.

A. Nano-Sized Particles

The present invention comprises at least one fabric softening active comprising a plurality of particles comprising an average particle size from about 10 nm to about 170 nm, alternatively less than about 150 nm, alternatively less than about 120 nm, alternatively less than about 80 nm. In one embodiment, comprises a plurality of particles comprising an intensity weighted particle size distribution wherein at least about 50% of said plurality of particles, alternatively at least 80%, alternatively at least 90%, to about 99%, alternatively about 99.9% have a particle size of less than about 170 nm, alternatively less than about 150 nm, alternatively less than about 120 nm, alternatively less than about 80 nm. As defined herein, average particle size and the intensity weighted particle size distribution are determined by the Dynamic Light Scattering Method as defined herein. In another embodiment, the plurality of particles comprise lamellar vesicles, discs, platelets, lamellar sheets, and combinations thereof.

Figure 2:
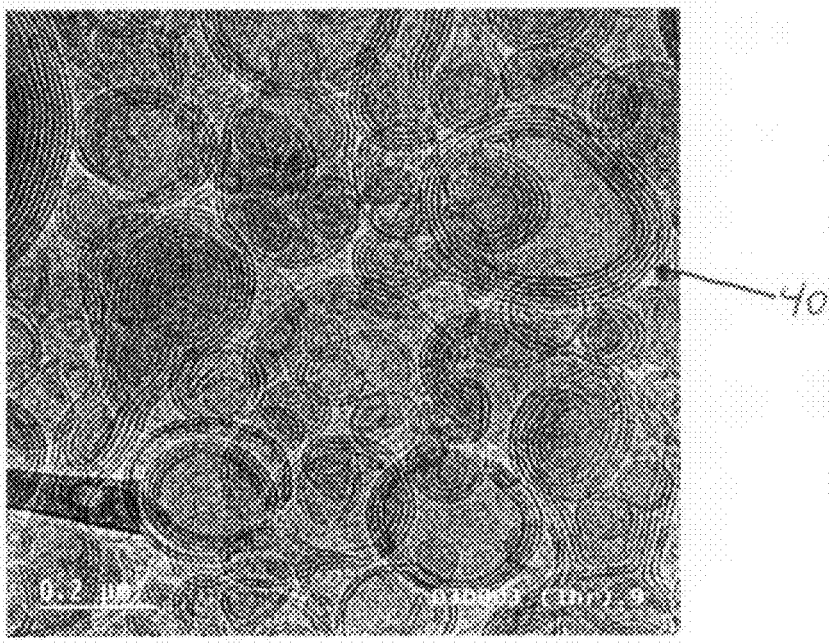
FIG. 2 provides a Cryo-TEM micrograph of a conventional fabric enhancing composition showing multi-lamellar vesicles having non-nano-sized diameters.

FIG. 1 provides a Cryo-TEM micrograph of a plurality of nano-sized particles (10) according to the present invention. FIG. 2 provides a Cryo-TEM micrograph of a conventional fabric enhancing composition showing a plurality of lamellar vesicles (40) having non-nano-sized diameters, e.g. with diameters greater than about 200 nm and being multi-lamellar.

1. Dynamic Light Scattering Method

The Dynamic Light Scattering Method can be used to measure the particle size by light scattering data techniques. As used herein, the particle size is determined with a Malvern Zetasizer Nano ZS—model ZEN 3600. Manufacturer: Malvern Instruments Ltd, Enigma Business Park, Grovewood Road, Malvern, Worcestershire WR14 1XZ, United Kingdom.

The software used for control of the instrument and for data acquisition is the Dispersion Technology Software version 4.20© Malvern Instruments Ltd.

The results are expressed as an intensity distribution versus particle size. From this distribution, the % based particles size distribution and the average particle size can be determined.

The sample is diluted with a dispersant that has similar composition as the continuous phase of the sample e.g water, solvent and acid in same amounts as in the dispersion continuous phase, to get a concentration of the fabric softening active of between about 1% and about 3% in the dispersion being measured. The samples should be taken at a consistent sample volume, e.g 5 ml. The sample is placed in a disposal cuvette (DTS0012 from Malvern) the measurement is taken at 25° C. with sample equilibration time of 2 minutes.

The measurement setting in the above defined software is 'manual measurement' with 20 runs/measurement and run duration of 10 sec's. The number of measurements is 2, without delay between measurements. The result calculation by the above software uses the general purpose model as provided by the software. The results need to meet the internally set quality criteria by soft and hardware.

B. Fabric Softening Active

The fabric enhancing compositions of the present invention comprises a fabric softening active (FSA) or a mixture of more than one FSAs. In one embodiment, the fabric enhancing composition comprises at least about 1%, alternatively at least about 2%, alternatively at least about 3%, alternatively at least about 5%, alternatively at least about 10%, and alternatively at least about 12%, and less than about 90%, alternatively less than about 40%, alternatively less than about 30%, alternatively less than about 20%, alternatively less than about 18%, alternatively less than about 15%, of said FSA, by weight of the composition. In one embodiment, the FSA is cationic.

One suitable FSA comprises compounds of the formula $$\{R_{4-m}—N^+—[(CH_2)_n—Y—R^1]_m\}X^- \quad (1)$$

wherein each R substituent is either hydrogen, a short chain $C_1$-$C_6$, suitably $C_1$-$C_3$ alkyl or hydroxyalkyl group, e.g., methyl, ethyl, propyl, hydroxyethyl, and the like, poly ($C_{2-3}$ alkoxy), suitably polyethoxy, benzyl, or mixtures thereof; each m is 2 or 3; each n is from 1 to about 4, suitably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$-$C_{22}$, suitably $C_{14}$-$C_{20}$, with each $R^1$ being a hydrocarbyl, or substituted hydrocarbyl group, and $X^-$ can be any softener-compatible anion, such as chloride, bromide, methylsulfate, ethylsulfate, sulfate, and nitrate.

A second suitable FSA has the general formula:

$$[R_3N^+CH_2CH(YR^1)(CH_2YR^1)]X^-$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]Cl^{(-)} \quad (2)$$

wherein each R is a methyl or ethyl group and suitably each $R^1$ is in the range of $C_{15}$ to $C_{19}$. As used herein, when the diester is specified, it can include the monoester that is present.

These types of agents and general methods of making them are disclosed in U.S. Pat. No. 4,137,180, Naik et al., issued Jan. 30, 1979. An example of a DEQA (2) is the "propyl" ester quaternary ammonium fabric softener active having the formula 1,2-di(acyloxy)-3-trimethylammoniopropane chloride.

A third suitable FSA has the formula:

$$[R_{4-m}—N^+—R^1_m]X^- \quad (3)$$

wherein each R, $R^1$, and $X^-$ have the same meanings as before.

A fourth suitable FSA has the formula:

(4)

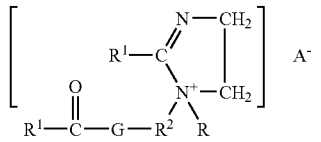

wherein each R, $R^1$, and $A^-$ have the definitions given above; each $R^2$ is a $C_{1-6}$ alkylene group, suitably an ethylene group; and G is an oxygen atom or an —NR— group.

A fifth suitable FSA has the formula:

(5)

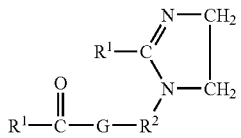

wherein $R^1$, $R^2$ and G are defined as above.

A sixth suitable FSA comprises condensation reaction products of fatty acids with dialkylenetriamines in, e.g., a molecular ratio of about 2:1, said reaction products containing compounds of the formula:

$$R^1—C(O)—NH—R^2—NH—R^3—NH—C(O)—R^1 \quad (6)$$

wherein $R^1$, $R^2$ are defined as above, and each $R^3$ is a $C_{1-6}$ alkylene group, suitably an ethylene group and wherein the reaction products may optionally be quaternized by the additional of an alkylating agent such as dimethyl sulfate. Such quaternized reaction products are described in additional detail in U.S. Pat. No. 5,296,622, issued Mar. 22, 1994 to Uphues et al.

A seventh suitable FSA has the formula:

$$[R^1—C(O)—NR—R^2—N(R)_2—R^3—NR—C(O)—R^1]^+A^- \quad (7)$$

wherein R, $R^1$, $R^2$, $R^3$ and $A^-$ are defined as above.

An eighth suitable FSA comprises reaction products of fatty acid with hydroxyalkylalkylenediamines in a molecular ratio of about 2:1, said reaction products containing compounds of the formula:

$$R^1—C(O)—NH—R^2—N(R^3OH)—C(O)—R^1 \quad (8)$$

wherein $R^1$, $R^2$ and $R^3$ are defined as above;

A ninth suitable type of FSA has the formula:

(9)

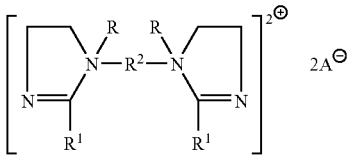

wherein R, $R^1$, $R^2$, and $A^-$ are defined as above.

Non-limiting examples of compound (1) are N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2 hydroxyethyl) N-methyl ammonium methylsulfate.

Non-limiting examples of compound (2) is 1,2 di(stearoyl-oxy) 3 trimethyl ammoniumpropane chloride.

Non-limiting examples of compound (3) are dialkylenedimethylammonium salts such as dicanoladimethylammonium chloride, di(hard)tallowedimethylammonium chloride dicanoladimethylammonium methylsulfate. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

A non-limiting example of compound (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

A non-limiting example of compound (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of compound (6) is the reaction products of fatty acids with diethylenetriamine in a molecular ratio of about 2:1, said reaction product mixture containing N,N-dialkyldiethylenetriamine with the formula:

$$R^1—C(O)—NH—CH_2CH_2—NH—CH_2CH_2—NH—C(O)—R^1$$

wherein $R^1$—C(O) is an alkyl group of a commercially available fatty acid derived from a vegetable or animal source, such as Emersol® 223LL or Emersol® 7021, available from Henkel Corporation, and $R^2$ and $R^3$ are divalent ethylene groups.

A non-limiting example of compound (7) is a difatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4—$$

wherein $R^1$—C(O) is an alkyl group, available commercially from the Witco Corporation e.g. under the trade name Varisoft® 222LT.

A non-limiting example of compound (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

A non-limiting example of compound (9) is the diquaternary compound having the formula:

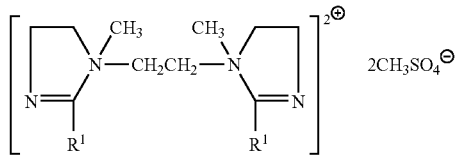

wherein $R^1$ is derived from fatty acid, and the compound is available from Witco Company.

It will be understood that combinations and mixtures of any of the above types of FSAs disclosed above are suitable for use in this invention.

Anion A

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. Other anions can also be used, such as methylsulfate, ethylsulfate, acetate, formate, sulfate, carbonate, and the like. Chloride and methylsulfate are suitable candidates for anion A. The anion can also carry a double charge in which case $A^-$ represents half a group.

C. Anionic Scavenger

As used herein, anionic scavengers include detergent scavengers and/or surfactant scavengers. It has been surprisingly been observed that fabric enhancing compositions of the present invention are capable of providing good anionic detergent carry over tolerance without reliance on added anionic scavengers as determined from the Floc Formation Test, defined herein. Without intending to be bound by theory, it is believed that the detergent carry over tolerance is due in part to the particle size distribution and/or the average particle size of the particles of the present invention. It is believed that the size of the particles and/or lamellar vesicles expose sufficient amounts of cationic charge to scavenge at least a portion of any detergent surfactant and/or laundry residue present in the rinse solutions of automatic and manual hand washing systems.

In one embodiment of the present invention, the fabric enhancing composition comprises an anionic scavenger. In one embodiment, the fabric enhancing composition comprises from about 0, alternatively from about 0.01% to about 10% of an anionic scavenger, alternatively to about 5%, alternatively to about 1%, alternatively to about 0.1%. In another embodiment, the fabric enhancing composition is free or substantially free of an anionic scavenger. As used herein, substantially free of a component means that no amount of that component is deliberately incorporated into the composition.

Suitable anionic scavengers include: monoalkyl quaternary ammonium compounds and amine precursors thereof; polyvinyl amines; and poly-quaternary ammonium compounds and amine precursors thereof. See e.g. U.S. Pat. Publ. No. 2003/0060390 at 0078-0122. It has surprisingly been found that the present invention provides suitable anionic detergent scavenging carryover and floc inhibition without reliance on added anionic scavengers. Without intending to be bound by theory, it is believed that the nano-sized particles provide sufficient exposure of the cationic portions of the FSA to inhibit the formation of flocs when contacted with laundry residue in the rinse bath solution.

D. SUD Suppressing System

In one embodiment of the present invention, the fabric enhancing composition comprises a sud suppressing system. Suitable levels of said suds suppressing system are from about 0.01% to about 10%, alternatively from about 0.02% to about 5%, and alternatively from about 0.05% to about 2% by weight of the composition. Such suds suppressing systems are suitable for use with the compositions of the present invention when used a rinse bath solution comprising laundry residue comprising a detergent residue from a surfactant system comprising high foaming surfactant, such as the conventional $C_{11}$-$C_{18}$ alkyl benzene sulfonates ("LAS").

Suitable suds suppressing systems include any known antifoam compound comprising a silicone antifoam compound, a alcohol antifoam compound like 2-alkyl alcanol antifoam compound, a fatty acid, a paraffin antifoam compound, and mixtures thereof. Non-limiting examples of suitable sud suppressing systems are provided in U.S. Pat. Publ. No. 2003/0060390 A1; and Kirk Othmer Encyclopedia of Chemical Technology, Third Edition, Volume 7, pages 430-447 (John Wiley & Sons, Inc., 1979).

Suitable compositions are those that have a suds reduction value of at least about 90%, alternatively at least about 95%, and alternatively at least about 99%. A suds reduction value of about 99% is where all the visible foam disappeared apart from the optional presence of a white film or some scattered air bubbles that may partially cover the surface of the solution.

Suds Reduction Test

Suds reduction is determined as follows: 750 grams of a dodecylbenzenesulfonic acid, sodium salt (technical grade, supplied by Aldrich under the catalog number 28,995-7) solution at about 0.02% (using water at 20°-25° C. and 12 US gpg hardness) is added to a 1 liter cylindrical jar (with a diameter to height ratio of approx. 5 to 8). This solution serves as reference. Both the reference solution and the filtrate obtained from the Floc Formation Test (see below) are shaken vigorously for about 15 seconds. This generates about 3 cm of foam on top of the reference solution. The remaining presence of foam on the test solution is assessed visually, 15 seconds after the shaking has finished. A sud reduction value in a % of height is calculated by comparing the height of the foam on the test sample after 15 seconds to the height of the foam on the reference sample immediately after shaking (~3 cm).

E. Other Elements

1. Perfume Additive

In one embodiment, the fabric enhancing composition comprises a perfume additive. As used herein "perfume additive" means any odoriferous material that is subsequently released into the aqueous bath and/or onto fabrics contacted therewith. The perfume additives herein can be relatively simple in their compositions or can comprise highly sophisticated complex mixtures of natural and synthetic chemical components, all chosen to provide any desired odor. More information about perfume actives, including nonlimiting examples of different perfume compositions is available in U.S. Pat. Publ. No. 2003/0104969A1 issued Jun. 5, 2003 to Caswell et al.; U.S. Pat. No. 5,714,137 issued Feb. 3, 1998 to Trinh et al.; and U.S. Pat. No. 6,048,830 issued Apr. 11, 2000 to Gallon et al.

In one embodiment, the perfume additive comprises a perfume microcapsule. Perfume microcapsules may include those described in the following references: U.S. Pat. Publ. Nos. 2003/215417 A1, 2003/216488 A1, 2003/158344 A1, 2003/165692 A1, 2004/071742 A1, 2004/071746 A1, 2004/072719 A1, 2004/072720 A1, 2003/203829 A1, 2003/195133 A1, 2004/087477 A1, 2004/0106536 A1; EP 1393706 A1; U.S. Pat. Nos. 6,645,479, 6,200,949, 4,882,220, 4,917,920, 4,514,461, 4,234,627 and U.S. RE 32,713. In one embodiment, the perfume microcapsule is a friable perfume microcapsule (versus, e.g., a water-activated perfume microcapsule). Friability refers to the propensity of the microcapsules to rupture or break open when subjected to direct external pressures or shear forces. For purposes of the present invention, the microcapsules utilized are "friable" if, while attached to fabrics treated therewith, they can be ruptured by the forces encountered when the capsule-containing fabrics are manipulated by being worn or handled (thereby releasing the contents of the capsule).

In one embodiment, the present invention comprises from about zero % to about 5%, alternatively from about 0.1% to about 3.5%, alternatively from 0.3% to 2% of a perfume additive.

2. pH Modifiers

In one embodiment of the present invention, the fabric enhancing composition further comprises a pH modifier in an appropriate amount to make the fabric enhancing composition acidic, having a pH in the range of below about 6, alternatively below about, alternatively from about 2 to about 5, alternatively from 2.5 to 4. Suitable levels of pH modifiers are from about zero % to about 4% by weight of the fabric enhancing composition, alternatively from about 0.01% to about 2%. Suitable pH modifiers comprises hydrogen chloride, citric acid, other organic or inorganic acids, and mixtures thereof.

3. Additional Additives

Those of ordinary skill in the art will recognize that additional additives are optional but are often used in fabric enhancing compositions. The fabric enhancing composition further comprises an additional additive comprising: water, colorants, perfumes, blooming perfumes, perfume microcapsules, cyclodextrin, odor controls, electrolytes, preservatives, optical brighteners, opacifiers, structurants, viscosity modifiers, deposition aids, fabric conditioning agents in solid form such as clay, emulsifiers, stabilizers, shrinkage controllers, spotting agents, germicides, fungicides, anti-corrosion agents, and mixture thereof, etc. See e.g. U.S. Pat. Nos. 4,157,307 to Jaeger et al., 5,942,217 to Woo et al., and 6,875,735 to Frankenbach et al. Additional suitable additives are known and can be included in the present formulation as needed. See e.g. U.S. Pat. Publ. No. 2004/0204337. In one embodiment, the fabric enhancing composition is free or substantially free of any of the aforementioned additives.

In one embodiment, the compositions of the present invention are free or substantially free of detersive surfactants. In one embodiment, the composition comprises less than about 5% of a detersive surfactant, alternatively less than about 2%, alternatively less than about 1%, alternatively less than 0.5%, by weight of the fabric enhancing composition.

In another embodiment, the fabric enhancing compositions of the present invention are free or substantially free of biological active (cosmetic or pharmaceutical) agents which are suited towards treating the symptoms and/or disorders living organisms, notably of the skin and hair. Further, in one embodiment, the composition is free of materials which are oxygen sensitive (e.g. agents such as retinol). U.S. Pat. Publ. Nos. 2002/0001613A1, at paragraph 45-48, and 2001/0124033, at paragraphs 42-43, provide examples of "biological active" agents which are notably absent in this embodiment of the present invention.

II. Anionic Detergent Carry Over Tollerance

Anionic detergent carry over tolerance and floc inhibition can be measured by the Floc Formation Test as defined herein. One embodiment of the invention provides for the absence or substantially the absence of floc formation in a first rinse bath solution under anionic surfactant carry-over conditions. A suitable Floc Formation Test Method is detailed in U.S. Pat. Appl. Pub. No. US 2003/0060390 at paragraphs 227-228.

Under this test, the absence and/or substantial absence of floc formation in a rinse solution containing residual anionic surfactant is an feature of the present invention. Floc Formation Testing method: 750 grams of a dodecylbenzenesulfonic acid, sodium salt (technical grade, supplied by Aldrich under the catalog number 28,995-7) solution at about 0.02% (using water at 20°-25° C. and 12 US gpg hardness) is added to a 1 liter cylindrical jar (with a diameter to height ratio of approx. 5 to 8). The jar is closed hermetically and shaken vigorously during 15 seconds to generate about 3 cm of foam on top of the solution.

Following this, 5 grams of the composition to be tested is poured on the surface of the foamed solution. The solution in the beaker is then manually stirred for 30 seconds at the rate of 100 rpm (with a 20 cm long, 0.5 cm plastic spatula). One minute after the stirring the solution is poured evenly over the surface of a USA Standard testing sieve (ASTM E11 specification No. 40, 35 mesh Tyler equivalent, opening 425 micron, sieve diameter 8 inch) which has been placed in a collecting tray. The dimensions of this tray are such that at the wires of the sieve are at least 1 cm below the surface of the liquid in the tray once the full 750 grams of test solution has been added. The sieve is subsequently manually lifted out of the tray (kept horizontally) and inspected for the presence of flocs. The test solution is being defined as being "substantially free" from flocs if the total number of visible flocs retained on the sieve is less than 50. The test solution is being defined as being "free" from flocs if the number of visible flocs retained is less than 10. The filtrate is collected in an identical 1 liter jar.

The test solution is defined as being "substantially free" from flocs if the total number of visible flocs retained on the sieve is less than about 50. The test solution is being defined as being "free" from flocs if the number of visible flocs retained is less than 10. One embodiment of the invention provides for the use of a fabric care composition of the present invention to soften fabric in a first rinse bath solution such that the rinse bath solution is free or substantially free from flocs in the first rinse bath solution.

III. Methods of Use

A. Rinse Process

The composition can be used in a so-called rinse process, where a composition as defined hereinabove, is first diluted in an aqueous rinse bath solution. Subsequently, the laundered fabrics which have been washed with a detergent liquor and optionally rinsed in a first inefficient rinse step. As defined herein, an inefficient step means that residual detergent, laundry residue, and/or soil may still be carried in the fabrics. These laundered fabrics are placed in the rinse solution with the diluted composition. Of course, the composition may also be incorporated into the aqueous bath once the fabrics have been immersed therein. Following that step, agitation is applied to the fabrics in the rinse bath solution causing the suds to collapse. The fabrics can then be optionally wrung before drying.

Accordingly, there is provided a method for rinsing fabrics, which comprises the steps of contacting fabrics, previously washed in a detergent liquor, with a composition of the invention. Likewise, the present invention provides for the use of a composition of the present invention to impart fabric softness to fabrics that have been washed in a high suds detergent solution, while providing in the rinse a reduction of suds or foaming and without the creation of undesirable flocs. In one embodiment, the process comprises a single rinse step and wherein said suds suppressor comprises from about 0.0% to about 5% by weight of the fabric enhancer. As used herein single rinse step means that only one step of rinsing is performed after the washing step, and before a drying step.

This rinse process may be performed manually in basin or bucket, in a non-automated washing machine, or in an automated washing machine. When hand washing is performed, the laundered fabrics are removed from the detergent liquor and wrung out. The composition of the invention is then added to fresh water and the fabrics are then, directly or after an optional inefficient first rinse step, rinsed in the water containing the composition according to the conventional rinsing habit. The fabrics can then be dried.

IV. Processing of Making

It has surprisingly been found that the compositions of the present invention can be manufactured using a process which involves cavitation within the composition generated by an ultra-sonic homogenizer. As used herein, ultra-sonic homogenizers include hydrodynamic cavitation reactors. Without intending to be bound by theory, it is believed that the hydrodynamic or ultrasonic cavitation causes sufficient disruption within the composition to create suitably sized nano-particles.

The process for manufacturing the present compositions comprises: providing a feed into a mixing chamber, where the feed contains at least a cationic softening compound and a solvent such as an aqueous carrier; then exerting an energy density onto said feed from about 1 J/ml to about 50 J/ml to cause intense cavitation within the feed within the mixing chamber to thereby produce a fabric enhancer. This process then includes the step of discharging the fabric enhancer at a flow rate from about 1 kg/min to about 1000 kg/min. In one embodiment, the feed is fed into said mixing chamber via an element forming an orifice. In one embodiment, the mixing chamber comprises a blade.

It is believed that the process step of subjecting the feed to an energy density onto said feed from about 1 J/ml to about 50 J/ml causes cavitation within the composition traveling within the mixing chamber causes sufficient disruption to the feed within the mixing chamber to cause the FSA to form nano-sized particles according to the present invention.

In another embodiment, the feed further comprises a pH modifier, a perfume, a solvent, and mixtures thereof. In a further embodiment, the feed is introduced into the mixing chamber using a dual feed wherein a first feed comprises water and a second feed comprising ingredients other than water. In a dual feed system, the water can be introduced at from about 10° C. to about 95° C., alternatively from about 20° C. to about 85 C, and the second feed can be introduced at from about 50° C. to about 95° C., alternatively from 70° C.

to about 90° C. In another embodiment, the feed is introduced into the mixing chamber using a single feed, where different compositions are combined prior to introduction into the mixing chamber. In another embodiment, the feed is not pre-mixed before being introduced into the mixing chamber.

In one embodiment, the device used to manufacture the fabric enhancer of the present invention is an ultrasonic homogenizer. Without intending to be bound by theory, it is believed that ultrasonic homogenizers achieve particle size reduction by hydrodynamic and/or ultrasonic cavitation. Further, it is believed that ultrasonic homogenizers are capable of operating at higher power and energy densities compared to conventional high shear mixers. See e.g. U.S. Pat. Publ. Nos. 2002/0001613 A1 to Neimiec et al., and 2004/0014632 A1 to Howard et al., and U.S. Pat. No. 5,174,930 to Stainmesse et al. One non-limiting example of a suitable ultrasonic homogenizer is the Sonolator™, supplied by Sonic Corporation of Connecticut.

A. Energy Density

Energy Density is generated by exerting a power density on the feed within the mixing chamber for a residence time. In one embodiment of the present invention, the step of cavitating said feed in said mixing chamber is performed having an energy density from about 1 J/ml to about 100 J/ml, alternatively from about 1 J/ml to about 50 J/ml, alternatively from about 5 J/ml to about 35 J/ml. Energy Density can be represented by the equation:

$$E=W*\Delta T$$

Where E represents energy density, W represents power density, and ΔT represents residence time. As defined herein, residence time means the average amount of time a vesicle remains within the mixing chamber. Residence time is determined by calculating the cavity size divided by the flow rate of fabric enhancer out of the mixing chamber.

B. Power Density and Residence Time

The fabric softener compositions of the present invention require relatively higher power density than conventional high sheer mixing. For ultrasonic mixing or a hydrodynamic cavitation reactor as used herein, power density can be determined by:

$$W=\Delta P/\Delta T$$

where W is the Power Density, ΔP is the applied pressure within the mixing chamber, and ΔT is the residence time.

In one embodiment, the energy density is generated from a power density of from about 0.5 W/ml to about 100,000 W/ml, alternatively from about 50 W/ml to about 30,000 W/ml. It is observed that the minimum Power Density required to achieve the fabric enhancer of the present invention is about 0.5 W/ml at 20 kHz.

Where the power density is about 0.5 W/ml, the residence time is about 15 minutes; alternatively, where the power density is about 100,000 W/ml the residence time is about 5 milliseconds. In one embodiment, the residence time is from about 1 millisecond (ms) to about 1 second, alternatively from about 1 ms to about 100 ms, alternatively from about 5 ms to about 50 ms. Further, where the residence time is less than 1 minute, the power density needs to be greater than 10 W/ml. Where the residence time is less than 1 second, the power density needs to be greater than 500 W/ml; alternatively. Where the residence time is less than 10 ms, the power density needs to be greater than 50,000 W/ml.

After the feed is subjected to the requisite energy density (as generated from the above mentioned power density and residence time), the fabric enhancer is discharged at a flow rate from about 1 kg/min to about 1000 kg/min, alternatively 10 kg/min to about 500 kg/min. Flow rate can be represented by the equation $Q=30\,A\sqrt{(\Delta P)}$, where Q=flow rate, A=orifice size, and ΔP=pressure within the mixing chamber. As defined herein, orifice size is the orifice cross sectional area. In one embodiment, the orifice size is from about 0.0001 inches$^2$ to 0.1 about inches$^2$, alternatively 0.0005 inches$^2$ to 0.1 about inches$^2$.

V. EXAMPLES

Example 1

A solution with 14% fabric softening active and acidic water is fed via dual feeds into a Sonolator™, supplied by Sonic Corporation of Connecticut. Both the quaternary ammonium compound and water are pre-heated to 70 degree C. The two streams then flow through the Sonolator® for one pass. The orifice size for this run is 0.0005 in^2. The resultant power densities are as follows:

| Pressure | Orifice size (in^2) | Flow rate (kg/min) | Power density (W/ml) | Energy Density (J/ml) |
|---|---|---|---|---|
| 1000 psi | 0.0005 | 1.79 | 20.6 | 6.89 |
| 2000 psi | 0.0005 | 2.53 | 58.2 | 13.78 |
| 3000 psi | 0.0005 | 3.11 | 107.0 | 20.67 |
| 5000 psi | 0.0005 | 4.01 | 230.2 | 34.45 |

| | Conditions from above | Feed Materials | Avg. particle diameter (nm) |
|---|---|---|---|
| #1A | 1 pass, dual feed, 5000 psi | 14% FSA, no electrolyte | 137.4 |
| #1B | 1 pass, dual feed, 5000 psi | 14% FSA, no electrolyte, 1.5% perfume | 132.0 |
| #1C | 1 pass, dual feed, 3000 psi | 14% FSA, no electrolyte | 146.5 |
| #1D | 1 pass, dual feed, 2000 psi | 14% FSA, no electrolyte | 144.9 |
| #1E | 1 pass, dual feed, 1000 psi | 14% FSA, no electrolyte | 164.7 |

The FSA used is a quaternary ammonium compound known as a soft tallow DEEDMAC with the following chemical name: N,N-di(tallowoyloxyethyl)-N,N-dimethylammonium chloride. This FSA is available from Degussa under the trade name of Adogen SDMC and has an IV value of about 56.

Run #1B has perfume added to the melt esters of quaternary ammonium compounds (softness active) just before the Sonolator® process. The concentration of the perfume in the finished product is 1.5%.

Example 2

Samples 2A-2F are prepared by mixing fabric softening active and acidic water into a Sonolator™, supplied by Sonic Corporation of Connecticut, using a dual feed process as described above. Samples 2G and 2H are prepared by dispersing liquid fabric conditioner active into acidic water using an IKA Overhead mixer. The particle size of these mixtures is measured using Dynamic Light Scattering. Perfume oil and suds suppressor are post-added to yield the compositions given in the table below. The detergent carry-over tolerance of these compositions is determined using the Floc Formation Test method as defined above.

| | 2A | 2B | 2C | 2D | 2E | 2F | 2G (4) | 2H(4) |
|---|---|---|---|---|---|---|---|---|
| Quat A (1) | 6.2% | 11.6% | 12.5% | — | — | — | | — |
| Quat B (2) | — | — | — | 12.4% | 12.5% | 12.4% | 12.4% | 12.4% |
| HCl | 0.013% | 0.013% | 0.013% | 0.013% | 0.013% | 0.013% | 0.013% | 0.013% |
| SE39 (3) | 0.5% | 1.0% | — | 1.0% | 1.0% | — | 1.0% | — |
| CaCl2 | — | — | — | — | — | — | 0.08% | 0.08% |
| Perfume | 0.9% | 1.8% | 0.9% | 1.8% | 0.9% | 1% | 1% | 1% |
| Avg. particle size | 85 nm | 100 nm | 95 nm | 72 nm | 70 nm | 75 nm | 550 nm | 550 nm |
| # Flocs | 0 | 0 | 0 | 0 | 0 | 0 | TNTC (5) | TNTC (5) |

(1) Di-alkylquat available from the Stepan Company under the tradename Stepantex KD
(2) Di-alkylquat available from Degussa under the tradename Rewoquat V3282
(3) Suds suppressor available from Wacker
(4) Dispersion made using standard mixing equipment (w/o hydrodynamic or ultrasonic cavitation)
(5) TNTC: Too Numerous To Count, greater than 50.

Examples 2A, 2B, 2C, 2D, 2E and 2F are within the scope of the present invention. Examples 2G and 2H are conventional fabric softening compositions which are not within the scope of the present invention.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Except as otherwise noted, the articles "a," "an," and "the" mean "one or more."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

All documents cited in the DETAILED DESCRIPTION OF THE INVENTION are, in the relevant part, incorporated herein by reference; the citation of any document is not to be construed as an admission that it is prior art with respect to the present invention. To the extent that any meaning or definition of a term or in this written document conflicts with any meaning or definition in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for rinsing a fabric comprising the rinse step of contacting the fabric, said fabric having been previously contacted with an aqueous detergent liquor and rinsed in a first inefficient rinse bath leaving detergent residue in said fabric, with an aqueous bath comprising a rinse solution containing a fabric softener composition comprising at least one cationic fabric softening active, wherein said fabric softening active comprises a plurality of particles comprising an intensity weighted particle size distribution wherein at least about 50% said particles have a particle size below about 170 nm, and a suds suppressor comprising a polyorganosiloxane with silica particle: said fabric softener composition having an acidic pH.

2. The method of claim 1, wherein said step of immersing the fabric in the aqueous bath subsequent to contact with a detergent liquor is substantially free of floc formation as determined by the Floc Formation Test Method.

3. The method of claim 2, wherein said fabric enhancing composition provides a suds reduction of at least about 90% as determined by the Suds Reduction Test.

* * * * *